US005933870A

United States Patent [19]

Egan, Jr. et al.

[11] Patent Number: 5,933,870

[45] Date of Patent: Aug. 10, 1999

[54] SHEATHING DEVICE FOR ADJUSTMENT STRAPS OF A CAP

[76] Inventors: Raymond C. Egan, Jr., 925 Cherry Valley Rd.; Thomas C. Burns, 161 Cleveland La., both of Princeton, N.J. 08540

[21] Appl. No.: 08/595,669

[22] Filed: Feb. 2, 1996

[51] Int. Cl.[6] ..... A42B 1/24

[52] U.S. Cl. ..... 2/209.13; 2/181.4; 2/181.6; 40/329; 138/178

[58] Field of Search ..... 2/181, 181.2, 181.4, 2/181.6, 195.2, 209.13; 40/329; 138/155, 177, 178

[56] References Cited

U.S. PATENT DOCUMENTS

| | | | |
|---|---|---|---|
| 5,003,640 | 4/1991 | Pizzacar | 2/199 |
| 5,282,278 | 2/1994 | Miner | 2/195.1 |
| 5,287,559 | 2/1994 | Christiansen et al. | 2/181 |
| 5,315,714 | 5/1994 | Peters et al. | 2/181.4 |
| 5,613,248 | 3/1997 | Young | 2/181 |

*Primary Examiner*—Diana Biefeld

*Attorney, Agent, or Firm*—Synnestvedt & Lechner

[57] ABSTRACT

A sheathing device is disclosed for covering and securing the entire length of the adjustable straps of a traditional cap. In this disclosure, a traditional cap has a front, back, top, bottom, at least one strap, and an engagement mechanism for releasibly engaging the strap at alternate points to adjust the size of the cap. The back has an opening at the bottom such that the bottom is parted to define two sides. The strap is attached to one side of the cap proximate to the opening. In one embodiment, the article comprises a sheathing. The sheathing has an inside region of adequate size to envelop the strap. Additionally, the sheathing's length is adjustable, allowing a user to customize its length such that it spans from one side to the other side to substantially conceal the strap when the opening is adjusted for the user's head. For example, the sheathing may comprises severable material allowing the user to cut the sheathing to the customized length. In this particular embodiment, it may be preferable for the sheathing to have an initial length sufficient to span the opening from one side to substantially the other side for the maximum cap size. Preferably, the sheathing is also pliable such that it flexes with the strap to conform to the user's head.

3 Claims, 3 Drawing Sheets

SHEATHING DEVICE FOR ADJUSTMENT STRAPS OF A CAP

BACKGROUND OF THE INVENTION

The invention relates generally to caps and accessories, and more specifically to a sheathing device that is used with a traditional cap to conceal and protect the adjustment straps. Covering and protecting the adjustment straps on a traditional cap is known in the art. Typically, devices of a predetermined length are used to encase the straps, but leave a significant portion of the straps uncovered. The uncovered portion renders the back of the cap visually unappealing. Therefore, a need exists to cover the entire length of the straps regardless of the cap's adjustment. The present invention fulfills this need.

SUMMARY OF THE PRESENT INVENTION

The present invention is directed at a sheathing device for covering and securing the entire length of a traditional cap's adjustable straps. In this disclosure, a traditional cap has a front, back, top and bottom, and at least one strap and engagement means for releasibly engaging the strap at alternate points to adjust the size of the cap. The back has an opening at the bottom such that the bottom is parted to define two sides. The strap is attached to one side of the cap proximate to the opening. In one embodiment, the article comprises a sheathing. The sheathing has an inside region of adequate size to envelop the strap. Additionally, the sheathing's length is adjustable, allowing a user to customize its length such that it spans from one side to the other side to substantially conceal the strap when the opening is adjusted for the user's head. For example, the sheathing may comprises severable material allowing the user to cut the sheathing to the customized length. The initial length of the sheathing in this case should be sufficient to span from one side of the opening to substantially the other side for the maximum cap size. Preferably, the sheathing is also pliable such that it flexes with the strap to conform to the user's head.

The following objects, features and advantages are met by one or more embodiments of the present invention:

It is an object of the invention to provide a sheathing that is tubular in shape.

It is a further object of the invention to provide a sheathing that has an adjustable length.

It is a feature of the invention that it may be adjusted to substantially conceal the straps of a traditional cap.

It is another feature of the invention that it holds the engagement means together.

It is an advantage of the present invention that it provides aesthetic and structural benefits to a traditional cap.

These and other objects, features and advantages of the invention will be apparent to those skilled in the art upon consideration of the following description of the invention.

BRIEF DESCRIPTION OF THE DRAWINGS

The features of the present invention, which are believed to be novel, are set forth with particularity in the appended claims. The invention may best be understood by reference to the following description taken in conjunction with the accompanying drawings, wherein like reference numerals identify like elements, and wherein:

DETAILED DESCRIPTION OF THE PRESENT INVENTION

Figure 1:
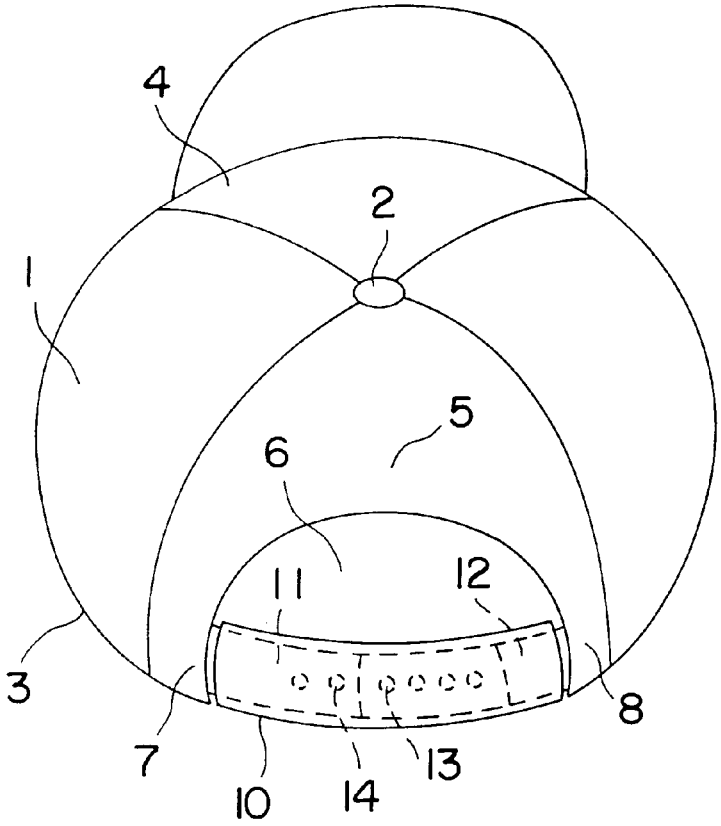
FIG. 1 shows a perspective view of the sheathing device in place covering the straps of a traditional cap.
Figure 7:
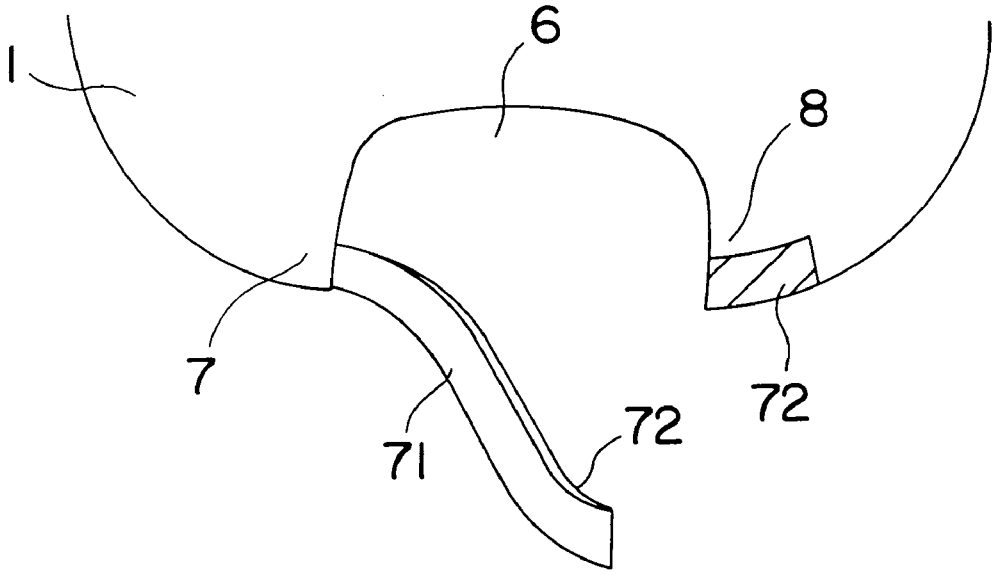
FIG. 7 shows a traditional cap with only one strap.

The present invention is directed at a sheathing device for covering, securing, and protecting the straps of a traditional cap 1. A shown in FIGS. 7, the traditional cap 1 in this disclosure refers to a cap, such as a base ball cap, having a front 4 (not shown), back 5, top 2, bottom 3, at least one strap 71, and engagement means 72 for releasibly engaging the strap 71 at alternate points along its length. The engagement means 72 may be any traditional fastener including male and female snaps, hook and loops fasteners, and buckles. For adjustment purposes, the back 5 has an opening 6 at the bottom 3 such that the bottom 3 is parted to define two sides 7, 8. FIG. 7 shows an embodiment having a single strap 71 disposed on one side 7, and the engagement means 72 disposed upon the strap 71 and the other side 8. The strap 71 is aligned such that the it may be releasibly engaged at various points along its length to adjust the opening 5, and consequently the cap's fit on the user's head. Alternatively, two straps 11, 12 may be used as shown in FIG. 1. In this embodiment, a male strap 11, having male snaps 14, attaches to one side 7 proximate to the opening 6, and a female strap 12, having female snaps 13 for receiving male snaps 14, is disposed on the other side 8. The straps 11, 12 are aligned enabling the engagement means, i.e., the snaps 13, 14, to releasibly engage. Again, the straps may be adjusted at various points relative to each other to achieve the desired fit. It should be obvious to someone skilled in the art that the placement of the male and female straps can be reversed, and moreover, other engagement means may be used besides male/female snaps.

In its basic embodiment, the article comprises a sheathing. The sheathing has an inside region of adequate size to envelop the strap. Additionally, the sheathing has an adjustable length allowing a user to customize its length such that it spans from one side to the other side to substantially conceal the strap when the opening is adjusted for the user's head. Preferably, the sheathing is made of pliable material such that it flexes with the strap to conform to the user's head. Suitable materials include nylon, rubber, flexible plastics, neoprene, as well as woven fabrics or webbed materials. The sheathing may be weaved or extruded into a sheathing. Alternatively, the sheathing may be manufactured starting with an essentially rectangular flat material that is turned such that parallel edges of the rectangle are joined thereby forming a sheath.

The article therefore covers and secures the straps providing both aesthetic and structural benefits. That is, the typically unsightly strap(s) 71 and the engagement means 72 used to adjust the cap (see FIG. 7) are concealed by sheathing, which, in its preferred embodiment, consists of visually appealing material. Additionally, the outer surface 52 of the sheathing (see FIG. 5) may be suitable for imprinting, embossing, or embroidering. The sheathing may therefore be inscribed with a logo, slogan, trademark, or other indicia, for advertising and promotional purposes. The particular technique used to imprint the indicia on the outer surface 52 of the sheathing depends upon various factors including the type of material that is used, the aesthetic appearance of the indicia, the ease in which the indicia may be disposed upon the sheathing, and cost. Due to the sheathing's tubular characteristics, it may also be rotated upon the strap to change the outwardly visible surface 54; the device is not restricted to just one outwardly visible surface 54. For example, a company may chose to provide the sheathing device with its company name on one side and its slogan on the other. The sheathing may then be rotated about the strap to change the outwardly apparent indicia. This feature turns a static article of apparel into a dynamic advertising and promotional tool.

Aside from appearances, the article also improves the structural integrity of the engagement means, and enables the cap to be permanently adjusted for a particular user. The straps in a typical cap stay fastened due to friction between the male and female engagement means. As caps become worn through use or frequent adjustment, however, these connections become loose and the frictional component is reduced. Eventually, the straps pull apart from each other. The present invention prevents this by snugly fitting around the strap(s) and the engagement means to essentially ensure positive engagement. By ensuring positive engagement, the device also adds an element of permanency to the adjustment. That is, once the hat is adjusted, the snug fit makes future adjustments of the cap difficult. A cap is therefore customized for a particular user in a permanent way.

Figure 5:
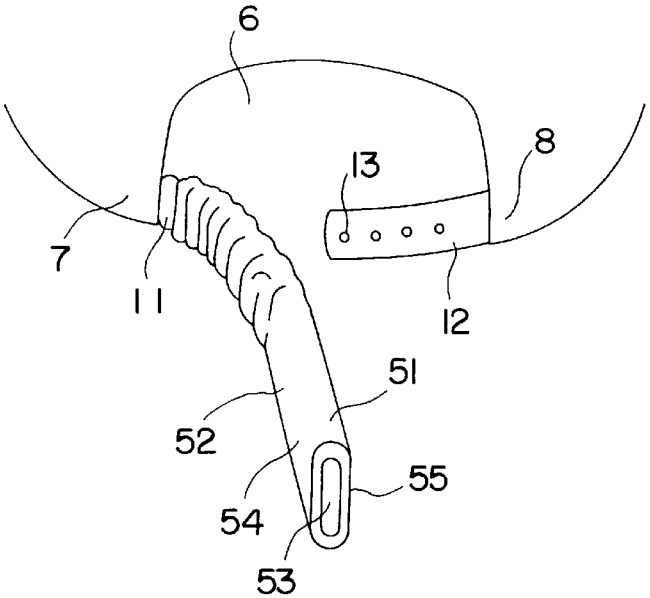
FIG. 5 shows the sheathing device in the process of being slid upon a strap.

One embodiment of the invention is shown in FIG. 1. There, the sheathing 10 is depicted on a traditional cap 1 having a male and female strap 11, 12. The sheathing 10 has an inside region 53 (see FIG. 5) of adequate size to envelop the straps 11, 12. A shown in FIG. 1, the sheathing's length has been customized such that it spans from one side 7 to the other side 8 to substantially conceal the straps 11, 12 that have been set for a particular user's head. The sheathing's cross-section may be any shape providing it envelops the strap or straps. In FIG. 5, a substantially oval shape is shown, however, due to the deformable nature of the fabric, the cross-section may assume various shapes.

Figure 3:
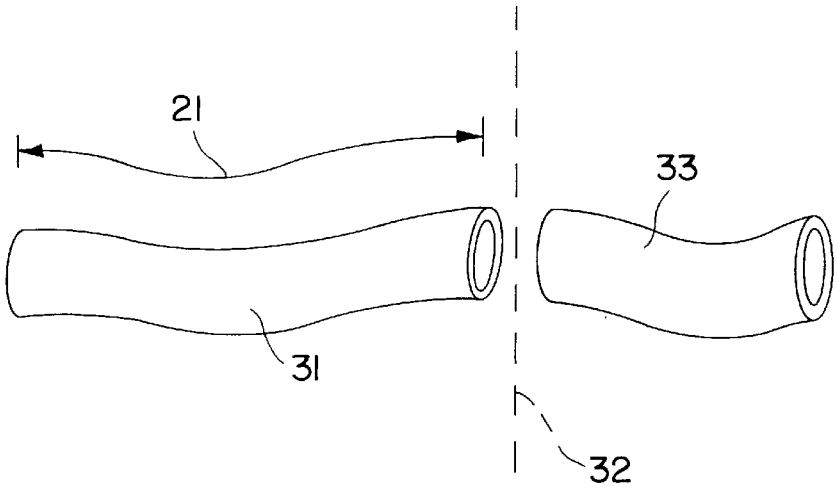
FIG. 3 shows the sheathing device cut along the dotted line to fit the certain distance as shown in FIG. 2.
Figure 4:
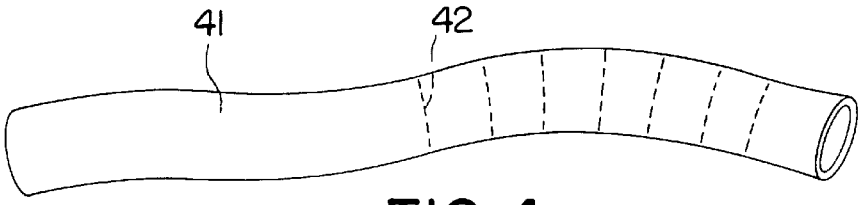
FIG. 4 shows perforations in the sheathing device for customizing its length.

The manner in which the sheathing's length is adjusted may vary. In the embodiment of FIG. 3, the sheathing 31 comprises severable material allowing the user to cut the sheathing along line 32 to the proper length 21, and to discard the unused portion 33. Rather than cutting it, the sheathing 41 may have perforations 42, enabling the user to tear it to the proper length as shown in FIG. 4. In either case, it is preferable to have a sheathing with an initial length sufficient to span from one side of the opening to substantially the other side when the strap is engaged to maximize the cap size. This way, there is always enough material to substantially conceal the straps regardless of the size of the user's head.

Figure 6:
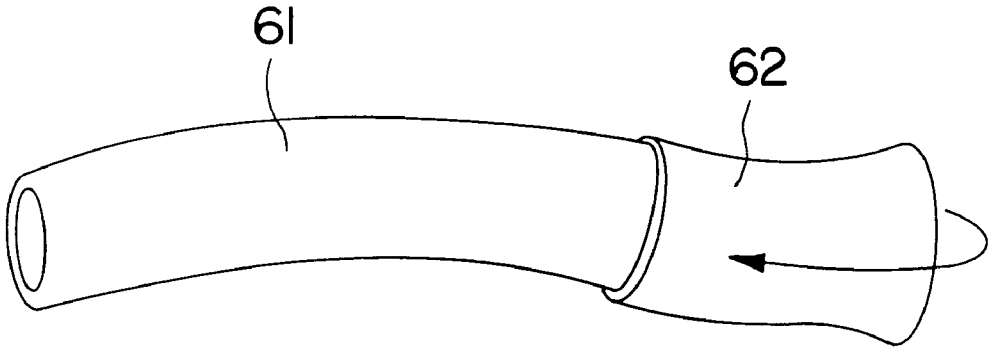
FIG. 6 shows the sheathing device being rolled to customize its length.

Although cutting or tearing the sheathing to size is the preferred means of customizing its length, other means of adjusting the length exist. For example, the sheathing may consist of a stretchable material allowing the user to stretch the sheathing to the customized length. Alternatively, the sheathing 61, as shown in FIG. 6, may comprise rollable material allowing the user to roll an end 62 of the sheathing 61 to arrive at the customized length.

Figure 2:
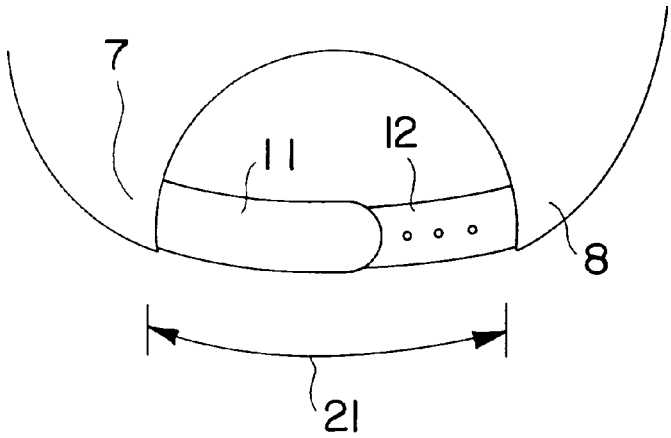
FIG. 2 shows a perspective view of a traditional cap with the straps releasibly engaged to each other to define a certain distance between the sides of the cap.

The present invention also entails a method of attaching the sheathing device to a traditional cap. To this end, the user first determines the length 21 from one side 7 to the other side 8 when the cap is adjusted in the ordinarily manner to fit properly as shown in FIG. 2. The user then employs the sheathing's adjustability to arrive at the customized length. Preferably, the customized length corresponds to length 21 such that the sheathing spans from one side 7 to the other side 8 to substantially conceal the straps when the opening is adjusted for the user's head. The entire customized length of the sheathing is slid onto one strap such that the engagement means of the strap is accessible. For example, the cap in FIG. 5 has two straps 11, 12 with male and female snaps 13, 14 (male snaps not shown). The sheathing 51 is slid over the strap 11 (obscured by the sheathing) until the engagement means, i.e., the male snaps, are exposed. Next, the engagement means are engaged to secure the strap(s). Finally, the sheathing is uniformly repositioned over strap(s) such that the strap (s) is substantially concealed. Where possible, the sheathing is also disposed about the engagement means to restrict the strap from releasing from the engagement means.

Due to the sheathing's snug fit about the strap, it may be difficult to adjust the straps with the sheathing over them; often times, the engagement means will be forced together prematurely. This problem may be avoided by first placing blocking means between the engagement means to prevent its premature engagement. The blocking means is removed or otherwise nullified when the straps are in the correct position relative to each other. For example, in FIG. 1, adhesive tape may be affixed to the female strap 14. After the sheathing is slid over one of the straps and when the straps are in the correct position for engagement, the straps are pressed together causing the male snaps to puncture the tape and engage the female snaps.

Obviously, numerous modifications and variations of the present invention are possible in the light of the above teachings. It is therefore understood that within the scope of the appended claims, the invention may be practiced otherwise than as specifically described herein.

What is claimed is:

1. An article of apparel for use with a traditional cap, said cap having a front, back, top and bottom, and at least one strap and engagement means for releasibly engaging said at least one strap at alternate points to adjust the size of said cap, said back having an opening at said bottom such that said bottom is parted to define two sides, said at least one strap attached to one side of said cap proximate to said opening, said article comprising:

a sheathing having an inside region for enveloping said at least one strap, said sheathing being a pliable material such that it flexes with said at least one strap, said sheathing having perforations to enable a user to tear it to a customized length.

2. The article of claim 1, wherein said sheathing has an outer surface adapted for inscription thereon.

3. The article of claim 1, wherein said sheathing has an outer surface with indicia printed thereon.

* * * * *